United States Patent [19]

Edgar

[11] 4,449,124

[45] May 15, 1984

[54] PRECOMPENSATED STROKE CATHODE RAY TUBE DISPLAY SYSTEM APPARATUS AND METHOD

[75] Inventor: Albert D. Edgar, Austin, Tex.

[73] Assignee: International Business Machines Corp., Armonk, N.Y.

[21] Appl. No.: 221,221

[22] Filed: Dec. 30, 1980

[51] Int. Cl.[3] ..... G09G 1/14

[52] U.S. Cl. ..... 340/739; 340/736; 340/735

[58] Field of Search ..... 340/732, 736, 739, 742, 340/735; 315/364, 367, 370

[56] References Cited

U.S. PATENT DOCUMENTS

| | | | |
|---|---|---|---|
| 3,333,147 | 7/1967 | Henderson | 340/324 |
| 3,364,479 | 1/1968 | Henderson et al. | 340/324 |
| 3,437,869 | 4/1969 | Cobb et al. | 315/18 |
| 3,540,032 | 11/1970 | Criscimagna et al. | 340/324 |
| 3,659,282 | 4/1972 | Tada | 340/324 A |
| 3,786,482 | 1/1974 | Puckett, Jr. et al. | 340/324 A |

*Primary Examiner*—Marshall M. Curtis

*Attorney, Agent, or Firm*—John W. Henderson, Jr.; Douglas H. Lefeve

[57] ABSTRACT

With a directed beam imaging system, a method is presented employing a low-pass filter in the positional signal path, a time-discrete positional signal, and precompensation of this time-discrete signal for phase and amplitude errors of the overall positional control circuitry. As a consequence of this method, the uncompensatable vector nonlinearities of the prior art vector stroke are obviated, the useable system bandwidth or stroke per unit time is extended beyond the prior art to the maximum driveable frequency, and in many text and graphics applications fewer strokes are needed to produce the desired image.

10 Claims, 6 Drawing Figures

PRECOMPENSATED STROKE CATHODE RAY TUBE DISPLAY SYSTEM APPARATUS AND METHOD

BACKGROUND OF THE INVENTION

1. Field of the Invention

This invention relates to display technology, and more particularly to the display of text information on a directed beam cathode ray tube.

2. Description of the Prior Art

Refresh displays may be broadly classified as raster, in which the beam is systematically moved to all points of the image and the information manifest by switching the beam on to light appropriate segments, or classified as directed beam, in which the beam is driven only along selected paths, the paths themselves portraying the information with beam switching supplemental. Directed beam is often called "stroke", but sometimes called "calligraphic", both refer to the "directed line" of penmanship. Raster is best at portraying solid areas of tone, such as in commercial TV, and stroke is best at portraying lines, as in graphics. A text display may be constructed with either technology.

Most directed beam displays operate to receive a sequence of positional coordinates and display a straight line between the present position and the new position. Such displays are also called vector stroke because the image is composed of discrete strokes, each a straight line vector. U.S. Pat. No. 3,659,282, issued Apr. 25, 1972, moves the beam between two arbitrary points in a series of tiny steps generated by a digital counter from a clock pulse source. To prevent positional staircasing, which would manifest in the image as a dotted line, a high frequency low-pass filter operates to smooth the tiny steps. U.S. Pat. No. 3,364,479, issued Jan. 16, 1968, achieves essentially the same result of generating straight lines by cascading a series of analog delays and summing equally the outputs. This yields a "boxcar averager" by which an impulse input is filtered to produce an output resembling a "square box", when viewed on an oscilloscope, as each delay outputs the impulse sequentially until the maximum delay is reached. In the display, as a new position is entered into the filter, the old position is still being output by the series delays. As time progresses, the new position is output by progressively more delay stages causing the command position to move uniformly in time to the new position. The command position reaches the new position at the maximum delay time, at which time a new coordinate is entered. In theory the same staircasing of the previous patent should result. However, the delay elements chosen provide sufficient low-pass filtering to obviate the need for a separate filter. U.S. Pat. No. 3,333,147, issued July 25, 1967, also operates to display a straight line using a boxcar averager, however in this case the desired function is approximated by a two-pole resonant low-pass filter. Because the beam does not move at a uniform rate, such systems often require a beam intensity control to modulate brightness in proportion to beam velocity to obtain uniform brightness vectors. U.S. Pat. No. 3,786,482, issued Jan. 15, 1974, generates the desired ramp functions accurately through the use of integrators implemented as current sources and capacitors. Integrators are special low-pass filters exhibiting a 20 db/decade attenuation slope for all frequencies. Two additional low-pass filters are shown at the output of the integrator, presumably to remove switching impulses produced by imperfections in the integrators.

Thus far, all prior art discussed has used a single deflection system. Such a system in a CRT must be either electrostatic deflection, which suffers from lower resolution, or magnetic deflection, which due to yoke inductance and resonances is limited to lower speed systems. A high-priced alternative for higher performance is illustrated in U.S. Pat. No. 3,437,869, issued Apr. 18, 1969. In this application two deflection systems are used. One is a high inductance, low-speed magnetic system and the second is a high-speed deflector capable of only very limited range. This second system is a low-inductance yoke in the above patent, but electrostatic micro-deflectors have also been used. In such a system operating, for example, as a text display, the beam center is slowly moved anywhere on the screen to character centers while the micro-deflectors rapidly form the characters around the centers. This system requires two complete sets of drivers, and effectively doubles the complexity of the logic circuits to dispatch tasks properly between the two drivers.

All of the above prior art has acted to produce straight-line vector strokes. U.S. Pat. No. 3,540,032, issued Nov. 10, 1968, uses a low-pass filter in series with the positional control signal and with a time constant about 1/5 the stroke rate. When both X and Y positions are updated simultaneously, the beam moves linearly to the new point, and in conjunction with intensity control circuitry a uniform straight line is displayed. However, if one direction, say the X-direction is updated first, followed by the Y-direction, initially the beam will move in the X-direction alone, followed by a time when both act in concert for a diagonal motion, eventually reaching a time when the X motion has terminated but the Y is still active, stroking a controlled curve on the image. The information required by the delay specification is similar to the introduction of an intermediate stroke, with each stroke changing only the target position of one axis.

As may be seen from this discussion of the prior art, low-pass filters are commonly used in stroke displays, their properties and actions within the system being the subject of several patents. However none have claimed or taught the use of a filter with fast attenuation beyond one-half the stroke frequency. All of the prior art systems assume the deflectors can reproduce the control signals with fidelity, limiting the speed of high resolution magnetic systems to frequencies much lower than the maximum driveable frequencies. At maximum driveable frequencies, magnetic deflection yokes exhibit multiple resonances, affecting gain and producing severe phase errors that are unreasonable to compensate. Such errors cause distortions of the vectors, such as spiraling, which cannot be compensated by merely moving the vector end points. The prior art presented three alternatives: (1) limited speed with a limited number of strokes per image, or (2) use of an electrostatic system with limited resolution and brightness, or (3) a costly dual deflector system was necessary.

SUMMARY OF THE INVENTION

It is therefore a primary object of this invention to provide a system capable of extending the useable bandwidth of a directed beam display to the maximum driveable frequency.

A corollary object is to increase the performance of a single-deflector magnetic stroke display system.

A related object is to provide a directed-beam system in which stroke linearity distortions may be corrected by adjustment of stroke end points alone.

A corollary objective is to provide means of accomplishing this correction.

A final objective is to provide a non-linear stroke shaping means permitting fewer strokes to produce a general curve or character.

The above objects are accomplished in accordance with this invention by inserting a fast-cut low-pass filter in the positional signal path to effectively remove signals at frequencies beyond the maximum frequency at which the beam may be reliably driven. The positional signal is updated in a time discrete fashion with at least twice this frequency, and is predistorted in a time quantized analog or digital system to correct phase and amplitude distortions of the positional signal path including the low-pass filter and the beam driver at frequencies below half the update frequency. Harmonic errors above this frequency are removed by the low-pass filter, permitting the stroke end points alone to define the complete beam path.

IN THE DRAWING

Figure 4:
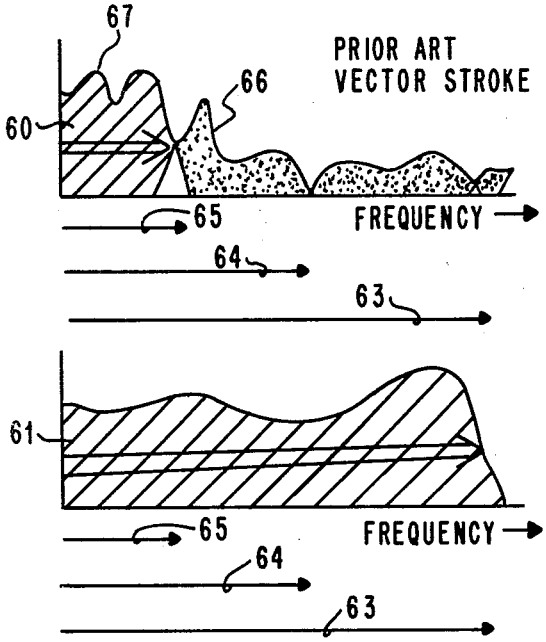

FIG. 4 charts the speed improvements of the present invention.

Figure 5:
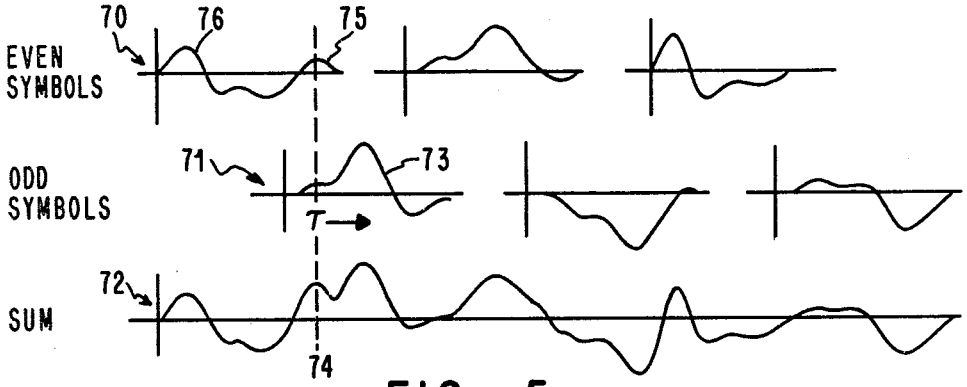
Figure 6:
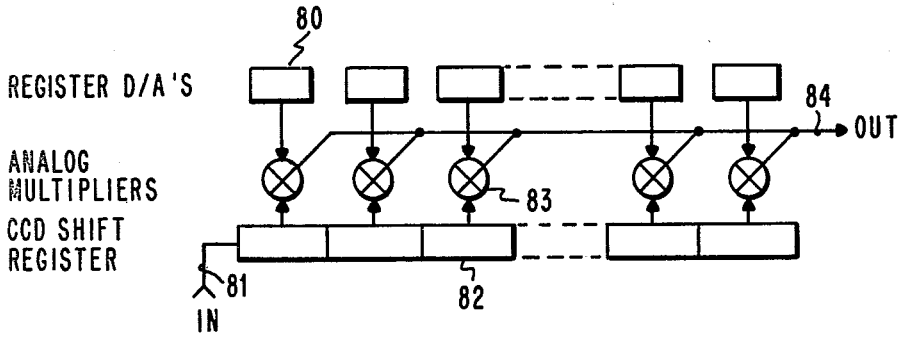

FIGS. 5–6 illustrate means of attaining the predistortion of the positional signal.

DESCRIPTION OF THE PREFERRED EMBODIMENT

Figure 1:
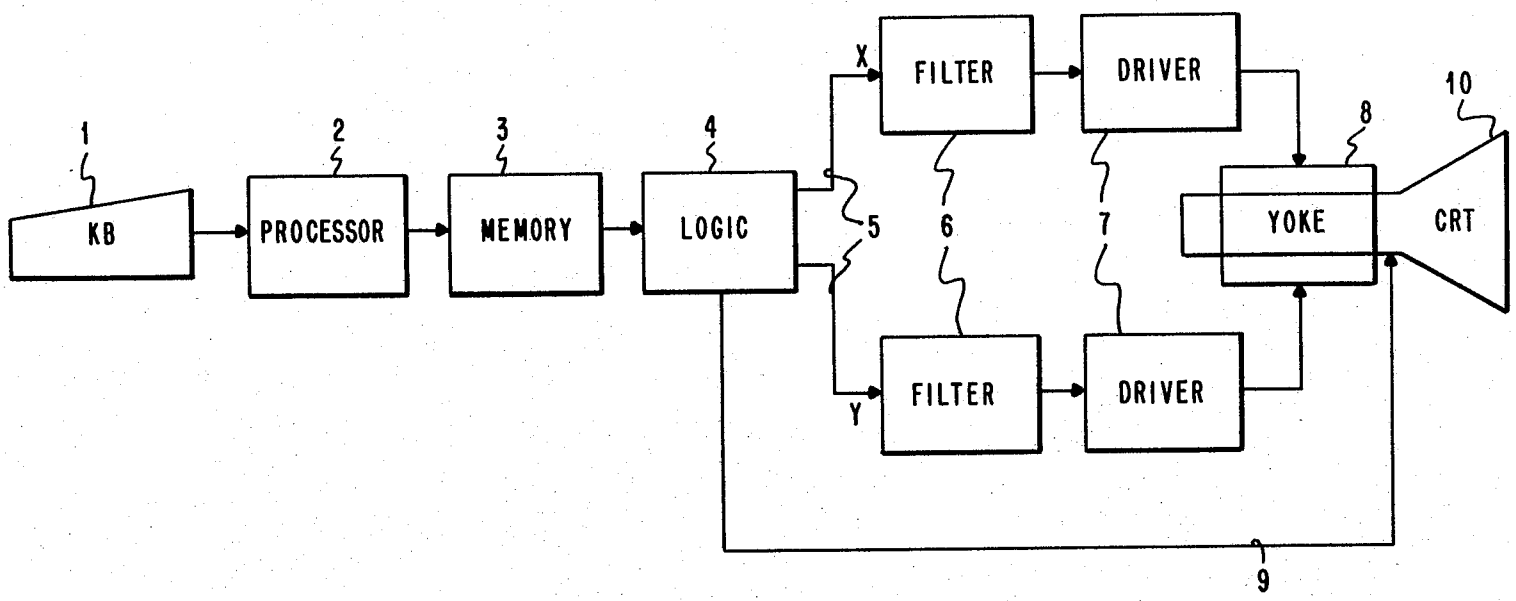
FIG. 1 is a block diagram showing the environment in which the system will operate.

Referring now to FIG. 1, a typical system environment is presented. This is done to clarify the interrelation of this invention with a representative application, and is not an implied limit on the applications in which this invention may be used. In FIG. 1, a keyboard 1 inputs data to a computer 2 which translates this data into a stroke format, that is into a series of X,Y coordinates and beam brightness commands that when plotted, form a visual interpretation of the data. These coordinates are stored in memory 3 where they may be recalled repetitively for refreshing a CRT. The logic block 4 reads these coordinates in the proper sequence and converts them into X and Y signals 5 which are then filtered by dual filters 6. The filtered signals are then amplified by drivers 7 and input to yoke 8, causing a beam to deflect. This beam is modulated by a beam brightness control signal 9 to produce an image on CRT 10. This patent will focus on the filter 6, and a precompensation of endpoints which may be effected in the logic block 4 or computer 2.

In stroke display systems, the image is subject to a number of distortion factors, particularly in the deflection drivers 7 and yoke 8, which must be compensated. The present invention provides an expedient whereby the compensation or preliminary correction may be applied to the digital signal pattern before the signal pattern is converted into the analog voltage pattern. In accordance with the present invention, filter means are provided which substantially eliminate the effect on the deflected beam of any frequencies in the analog voltage pattern applied to the deflection means which are higher than one-half the stroke frequency of the CRT system. With this elimination, means for modifying the digital signal pattern for error precompensation are sufficient, rather than more costly expedients.

Figure 2:
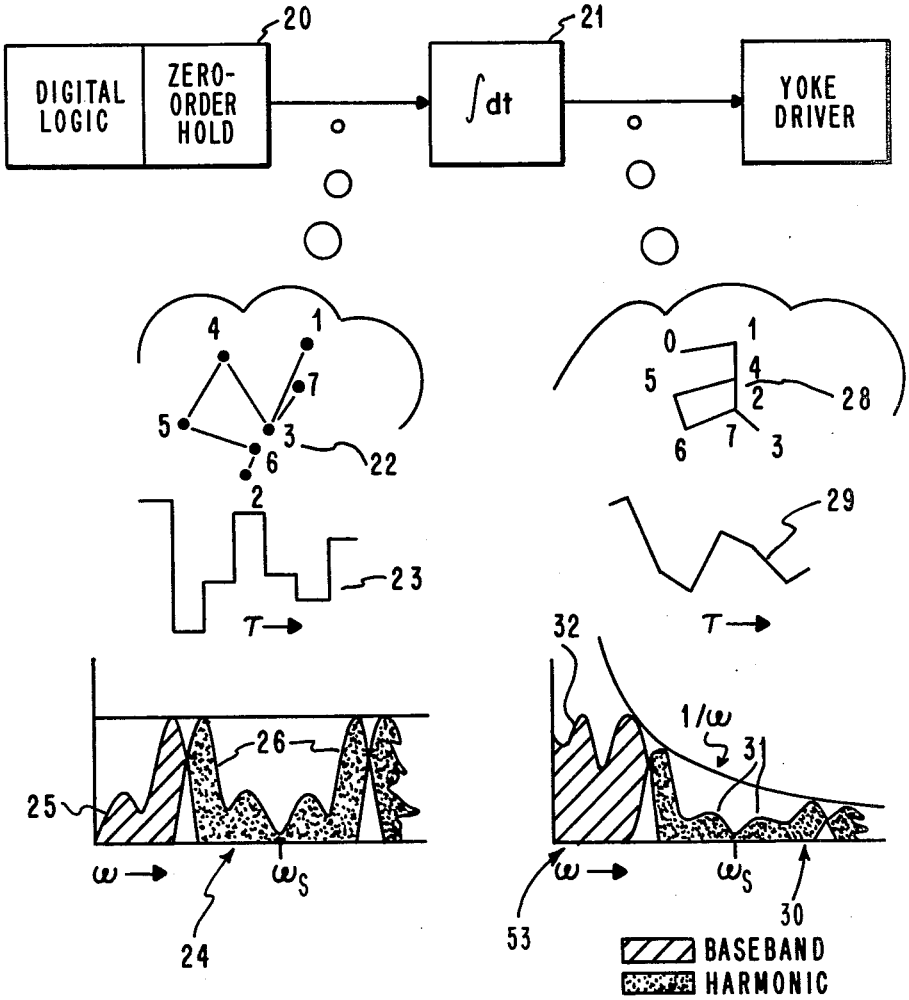
FIG. 2 illustrates the spatial and spectral nature of signals at points in a vector stroke display.

This invention will be presented using frequency analysis. First the frequency characteristics of the prior art vector stroke system are derived for comparison. The prior art system, represented in FIG. 2, may be thought of as a zero-order hold 20 output through an integrator 21 to obtain straight line interpolation. This model simplifies explanation of the spectrum of the signal to the yoke drivers. In FIG. 2, the output of the zero-order hold 20 would move the beam so as to form a series of dots on the screen 22. The beam velocity, forming the lines that are visually perceived, would be a series of impulses, and hence the visually perceived spectrum 24 at these points would contain a baseband 25 (slashed area) followed by equal intensity harmonic sidebands 26 on either side of any integer multiple of the sample frequency $\omega_s$, extending to infinity. The perceived spectrum 24 is the spectrum of the derivative of the time-position function 23. The position derivative or velocity, of the beam represents the visually perceived importance of each spectral component of the motion of the beam. At this point the signal spectrum is essentially flat, and thus, using conventional terminology, "white". The integrator block 21 provides an amplification proportional to $1/\omega$, where $\omega$ is used conventionally to indicate frequency. This multiples the spectrum of the signal from the zero-order hold 20, producing a "pink" spectrum 30. The analogues to the screen image 22 and positional signal 23 are shown as 28 and 29.

The multiplied spectrum 30 following the integrator 21 of FIG. 2 illustrates the signal that must be reproduced by the yoke and driver in vector stroke. Although the harmonics 31 are completely redundant to the baseband 32, they must be correctly followed. The worst problem is driver phase error, which usually appears at a lower frequency than driver amplitude distortion, and interacts with the vector harmonics to produce spiraling and linearity distortions of the "straight" lines. Adjustment of the endpoints cannot correct for the yoke and driver. Because of the spectral redundancy, correction of harmonics by adjusting endpoints distorts the baseband. For fidelity reproduction the yoke and driver must have an undistorted passband substantially wider than the baseband of the digital signal.

Next the effect of an ideal low-pass filter is considered. The filter with cutoff frequency half the sampling frequency is added to the system of FIG. 2 to form the system of FIG. 3. Let this addition be considered for a moment. Not only is a nearly ideal low-pass filter nearly impossible to implement, but the intentional bandwidth limitation of the driver seems counterproductive. Yet it will be seen that a large improvement is realized in performance, and the low-pass filter can in reality be far from ideal.

Figure 3:
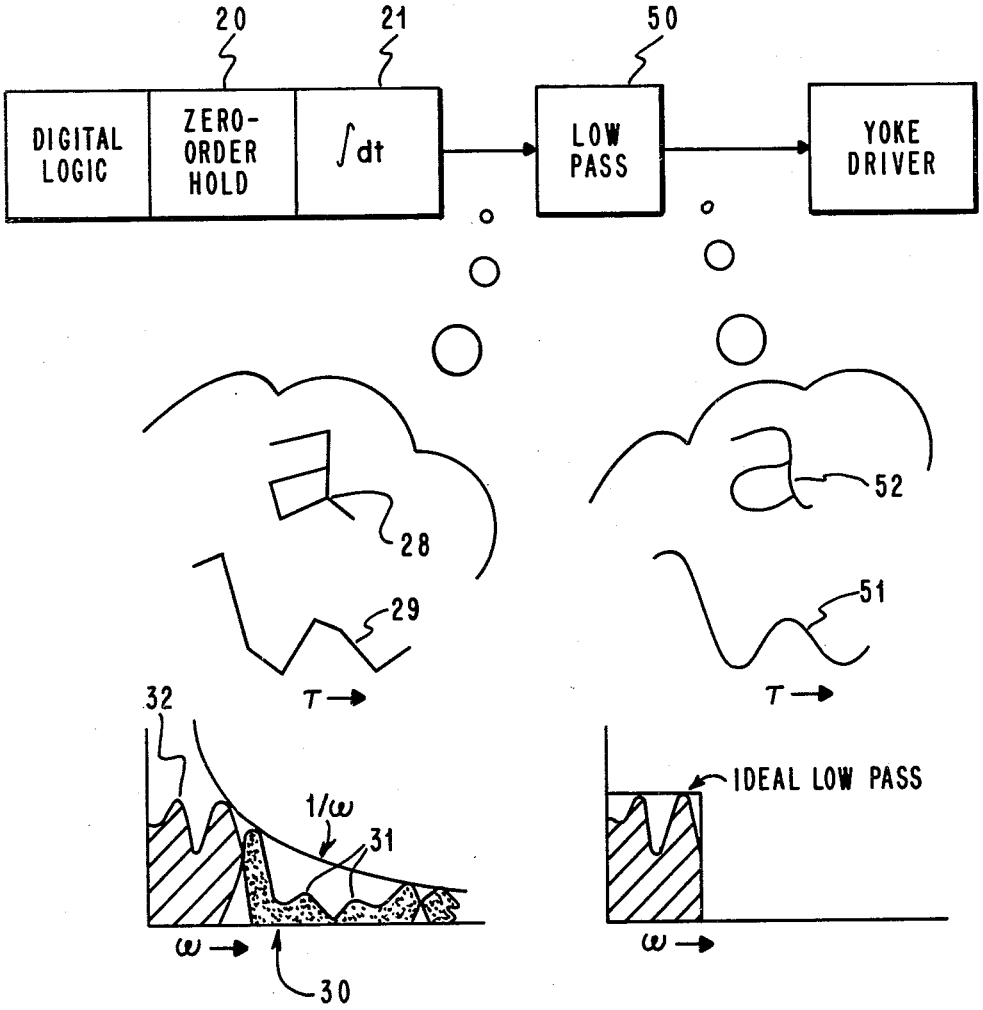
FIG. 3 illustrates the spatial and spectral effects of the fast-cut low-pass filter.

Referring now to FIG. 3, low-pass filter 50 is added to the positional signal path. Elements 20, 21, and 28 to 32 are identical to the same numbered elements in FIG. 2. The low pass filter 50 affects the positional signal plotted versus tile in graph 29 to produce that of 51, modifying the screen image 28 of vector-stroke to image 52. In the frequency domain, the signal following the low-pass filter 50 has the form 53, which has none of the harmonics 31 of spectrum 30.

An important result of eliminating harmonics is the elimination of spectral redundancy. That is, to the extent that the harmonics are eliminated from the signal, the entire remaining signal can be completely controlled by controlling only the updating of the signal at discrete times. In the case of a stroke display, by adjusting only the endpoints, the entire line can be made to follow the same path independent of frequency and phased distortions. This is the consequence of the Sampling Theroem which is known to those versed in the art.

Thus any linear driver-yoke distortions can be exactly corrected by correcting the endpoints alone. Any errors in gain or phase are thus correctable by precorrecting endpoints, which may be done in software, or permanently in the character read only memory. The yoke can thus be driven as fast as the beam can be moved, without waiting for phase or gain to settle. Errors in the low-pass filter passband may be corrected as though part of the driver-yoke, removing many gain constraints and all phase constraints on the low-pass element. All that is required of the filter-driver-yoke function $G(\omega)$, given sampling frequency $\omega_s$, is that the ratio:

$$G(NX\omega_s \pm \omega)/G(\omega)$$

be very small for all $\omega < \omega_s/2$ and integer $N\omega \geqq 1$. This constraint is satisfiable with simple all-pole resonating filters, such as a Chebyshev filter, and allows some unusual driver circuitry, such as a capacitive and parallel resistive element in series with the inductive yoke in which resonance, with resulting phase distortion, is purposefully introduced to extend the maximum drivable frequency and to provide a faster cutoff in a voltage-limited system.

Because there are no harmonics to reproduce following the low-pass function, and any errors in gain or phase are easily correctable, the full yoke-driver bandwidth can be utilized as illustrated in FIG. 4. This figure plots the frequency components of a signal in the prior art vector stroke 60 and those of a system using the teachings of this application in plot 61. Three ranges of frequencies are shown: the maximum driveable range 63 includes those frequencies at and beyond yoke resonance at which current can be forced through a yoke to deflect a beam, but phase and amplitude distortions of the signal are severe. The controllable range 64 is shorter, and includes only those frequencies at which a system can be reasonably built to reproduce a signal with fidelity, and thus excludes the highest driveable frequencies. For example, if a feedback circuit is used, non-minimum phase and parasitic frequencies are excluded. The third range 65 relates to the vector stroke spectrum 60. Because in vector stroke the harmonics 66 must be correctly reproduced as well as the baseband 67, the harmonics 66 must be within the controllable range 64, and hence the useful bandwith 65, which is only the range covered by the baseband 67, must be quite short. On the other hand, because the method of this application permits simple correction of phase and amplitude distortions, and in addition there are no harmonics so the full bandwidth is useable, the spectrum 61 may extend to the maximum driveable frequency, and thus it has a useful bandwidth 63 identical to the driveable range discussed above. A wider useful bandwidth means that strokes may be output faster, which means more strokes may be written into an image that must be completed and restarted for refresh in a fixed time limit, or a lower cost system may be used without reducing the number of strokes in an image.

There are several ways the stroke endpoint correction can be accomplished. If a character generator based system is used as in a text application, the predistortion may be computed once convolving the desired response with the inverse transfer function of the filter-driver-yoke combination, and the distorted symbols permanently stored. This approach has a difficulty in that typically the correction for one symbol must begin earlier, and end later than the symbol itself. If the correction time spread is small, a brief pause between symbols provides the necessary settling time. In higher speed systems, symbols may be interlaced, so that suffix correction for one may occur coincident with prefix correction for the next. The operation of such a system is illustrated in FIG. 5 where the predistorted stored signal for even symbols 70 and odd symbols 71 are summed to form the control signal 72. Note that upon entering the signal for symbol 73 at time 74, the suffix correction 75 for symbol 76 is still occurring, and is added with symbol 73 to form the sum control signal 72.

Another method of precorrection using modifiable memory to store an arbitrary string of stroke patterns uses a computer or equivalent hardware circuitry to digitally correct a string of stored digital numbers by convolution with the inverse transfer function of the display system. The string of stored digital numbers may be derived from a conventional character generator or other algorithm. The teachings of this invention permit complete correction by correcting only discrete numbers corresponding to stroke endpoints, and hence such a system is possible. The techniques of linear digital signal processing are well known in the art, and may be found in the text book, DIGITAL SIGNAL PROCESSING, by Oppenheim and Schafer, Prentice-Hall, 1975. Because the teachings of this invention permit a time-discrete correction, a similar correction process may be accomplished in analog using an analog shift register and multipliers as in FIG. 6. In this implementation, the correction numbers, which are the inverse of the filter-driver-yoke transform, are loaded into a series of registers 80. These numbers remain static, being changed only during trimming or alignment. The desired time discrete signal 81 is input to analog shift register 82. The output of each stage of the shift register is multiplied with the corresponding correction number by multipliers 83, and the product of all stages summed to form a convolution which is output 84. The registers 80 and multipliers 83 may be combined in a multiplying D/A converter, and of course other combinations are possible.

Typically, the errors introduced by the filter-driver-yoke system will be non-minimum phase, and hence after precompensation a net group delay will occur. The beam switching signal must be delayed a matching amount so that the stroke will start and end at the desired points along the stroked line. This delay can be introduced by conventional means. The precompensation can be adjusted in phase so the required delay is an integer multiple of the stroke update frequency, allowing a simple shift register delay implementation.

To this point, the method of this application has been shown to allow substantially more strokes per unit time, however the system also requires fewer strokes per symbol. In addition, the style of characters generated can be considered more graceful than conventional vector stroked ones.

Conventional vector stroke generates redundant spectral components. It thus assumes something about the image. The assumption is of course that the image is made of straight lines and angles. This assumption pays when lines and angles are being reproduced, as in the characters below:

i k l t v w x y z

However, like any "compression" scheme, a pattern outside the design range is disproportionately difficult. Curves are outside the design range of conventional vector stroke, and so are the characters below:

a b c d e f g h j m n o p q r s u

The filtered patterns of this application are nonredundant. They assume nothing, or, stated another way, they assume maximum entropy. They are adapted to nonspecific patterns, such as most text, handwriting, graphics, and general non-coded information. A very readable font for text using only 4.5 strokes per character box is possible using the method taught in this application.

This application has used a CRT as a descriptive model, however the same resonances and response errors are exhibited in other display and printer systems, including mechanical systems and hence the methods of this invention are directly applicable. Examples of such systems improved by this invention are mechanical plotters and displays using a vibrating mirror for beam deflection.

Less bandwidth per stroke, wider channel bandwidth, more strokes per unit time, fewer strokes per symbol, and less sensitivity to yoke resonances permit the use of single yoke deflection. Better shaped characters with simpler hardware, or restated, lower cost with higher performance, is the result of the method of this invention. It will be obvious to one skilled in the art that modifications to the specific examples used for illustration may be made without departing from the spirit and scope of this invention.

What is claimed is:

1. In a stroke display system for the display of images the improvement comprising in combination:

digital means providing a sequential digital signal pattern at a selected stroke frequency, said digital signal pattern being a function of the linear image to be displayed;

means to convert said digital signal pattern into a sequential analog voltage pattern;

beam deflection means;

analog filter means for filtering said analog voltage pattern; and means for coupling the filtered analog voltage pattern to said beam deflection means to drive said deflection means;

said filter means substantially eliminating the effect on the deflected beam of the harmonic sidebands of said selected stroke frequency in said analog voltage pattern;

said digital means including means for precorrecting stroke endpoints to an extent necessary to compensate for errors in said filter means and in said beam deflection means.

2. In a stroke display system for the display of symbol images the improvement comprising:

storage means providing a sequential digital signal pattern at a selected stroke frequency, said digital signal pattern being a function of the symbol images to be displayed;

means to convert said digital signal pattern into first and second analog voltage patterns, said first and second analog voltage patterns representing alternate ones of said symbol images;

means for summing said first and second analog voltage patterns;

beam deflection means;

analog filter means for filtering the summed analog voltage pattern; and means for coupling the filtered analog voltage pattern to said deflection means to drive said deflection means;

said filter means substantially eliminating the effect on the deflected beam of the harmonic sidebands of said selected stroke frequency in said analog voltage pattern;

said digital means including means for precorrecting stroke endpoints to an extent necessary to compensate for errors in said filter means and in said beam deflection means.

3. An improved method for displaying images on a stroke display system comprising the steps of:

(a) storing and outputting a sequential digital signal pattern at a selected stroke frequency, said digital signal pattern being a function of the image to be displayed;

(b) converting said digital signal pattern into a sequential analog voltage pattern;

(c) filtering said analog voltage pattern to substantially eliminate harmonic sidebands of said selected stroke frequency in said analog voltage pattern; and (d) coupling the filtered analog voltage pattern to the CRT for displaying said linear images;

(e) said storing and outputting including precorrecting stroke endpoints to an extent necessary to compensate for errors in said filtering and in said coupling said filtered analog voltage pattern to said CRT.

4. An improved method for displaying symbol images on a stroke display system comprising the steps of:

(a) storing and outputting a sequential digital signal pattern at a selected stroke frequency, said digital signal pattern being a function of the symbol images to be displayed;

(b) converting said digital signal patterns into first and second analog voltage patterns, said first and second analog voltage patterns representing alternate one of said symbol images;

(c) summing said first and second analog voltage patterns;

(d) filtering the summed analog voltage patterns to substantially eliminate harmonic sidebands of said selected stroke frequency in the analog voltage pattern; and (e) coupling the filtered analog voltage pattern to the CRT for displaying said symbol images;

(f) said storing and outputting including precorrecting stroke endpoints to an extent necessary to compensate for errors in said filtering and in said coupling said filtered analog voltage pattern to said CRT.

5. The method of claim 3 or claim 4 wherein said precorrecting stroke endpoints includes adjusting the start coordinates and/or end coordinates of the digital signal pattern.

6. In a stroke display system for the display of images the improvement comprising in combination:

digital means providing a sequential digital signal pattern at a selected stroke frequency, said digital signal pattern being a function of the linear image to be displayed;

means to convert said digital signal pattern into a sequential analog voltage pattern;

beam deflection means;

analog filter means for filtering said analog voltage pattern; and means for coupling the filtered analog voltage pattern to said beam deflection means to drive said deflection means;

said filter means substantially eliminating the effect on the deflected beam of the harmonic sidebands of said selected stroke frequency in said analog voltage pattern;

said means to convert including means for precorrecting stroke endpoints to an extent necessary to compensate for errors in said filter means and in said beam deflection means.

7. In a stroke display system for the display of symbol images the improvement comprising:

storage means providing a sequential digital signal pattern at a selected stroke frequency, said digital signal pattern being a function of the symbol images to be displayed;

means to convert said digital signal pattern into first and second analog voltage patterns, said first and second analog voltage patterns representing alternate ones of said symbol images;

means for summing said first and second analog voltage patterns;

beam deflection means;

analog filter means for filtering the summed analog voltage pattern; and means for coupling the filtered analog voltage pattern to said deflection means to drive said deflection means;

said filter means substantially eliminating the effect on the deflected beam of the harmonic sidebands of said selected stroke frequency in said analog voltage pattern;

said means to convert including means for precorrecting stroke endpoints to an extent necessary to compensate for errors in said filter means and in said beam deflection means.

8. An improved method for displaying images on a stroke display system comprising the steps of:

(a) storing and outputting a sequential digital signal pattern at a selected stroke frequency, said digital signal pattern being a function of the image to be displayed;

(b) converting said digital signal pattern into a sequential analog voltage pattern;

(c) filtering said analog voltage pattern to substantially eliminate harmonic sidebands of said selected stroke frequency in said analog voltage pattern; and (d) coupling the filtered analog voltage pattern to the CRT for displaying said linear images;

(e) said storing and outputting including precorrecting said voltage patterns before filtering to an extent necessary to compensate for errors in said filtering and in said coupling said filtered analog voltage pattern to said CRT.

9. An improved method for displaying symbol images on a stroke display system comprising the steps of:

(a) storing and outputting a sequential digital signal pattern at a selected stroke frequency, said digital signal pattern being a function of the symbol images to be displayed;

(b) converting said digital signal patterns into first and second analog voltage patterns, said first and second analog voltage patterns representing alternate one of said symbol images;

(c) summing said first and second analog voltage patterns;

(d) filtering the summed analog voltage patterns to substantially eliminate harmonic sidebands of said selected stroke frequency in said analog voltage pattern; and (e) coupling the filtered analog voltage pattern to the CRT for displaying said symbol images;

(f) said storing and outputting including precorrecting analog voltage patterns before filtering to an extent necessary to compensate for errors in said filtering and in said coupling said filtered analog voltage pattern to said CRT.

10. The method of claim 8 or claim 9 wherein said step of precorrecting said analog voltage patterns before filtering includes adjusting the start coordinates and/or end coordinates of the digital signal pattern.

* * * * *